US005685607A

United States Patent [19]

Hirschmann

[11] Patent Number: 5,685,607

[45] Date of Patent: Nov. 11, 1997

[54] OFFICE CHAIR SEAT CARRIER

[75] Inventor: Manfred Hirschmann, Burgthann, Germany

[73] Assignee: S I F A Sitzfabrik GmbH, Sulzbach-Rosenberg, Germany

[21] Appl. No.: 544,084

[22] Filed: Oct. 17, 1995

[30] Foreign Application Priority Data

Oct. 17, 1994 [DE] Germany ..... 9416595 U
Feb. 8, 1995 [DE] Germany ..... 29502040 U

[51] Int. Cl.[6] ..... A47C 3/00

[52] U.S. Cl. ..... 297/301.7; 297/300.8; 297/328; 403/325

[58] Field of Search ..... 297/301.7, 300.5, 297/300.8, 302.7, 328, 374, 376, 375; 403/95, 325

[56] References Cited

U.S. PATENT DOCUMENTS

| | | | |
|---|---|---|---|
| 5,066,069 | 11/1991 | DeGelder | 297/300.8 X |
| 5,356,200 | 10/1994 | Stumpf et al. | 297/328 |
| 5,397,165 | 3/1995 | Grin et al. | 297/300.5 |
| 5,423,595 | 6/1995 | Hancock | 297/328 X |

FOREIGN PATENT DOCUMENTS

| | | |
|---|---|---|
| 0045925 | 8/1981 | European Pat. Off. . |
| 0648451 | 8/1994 | European Pat. Off. . |
| 9211244 | 8/1992 | Germany . |
| 8600508 | 1/1986 | WIPO . |
| 9611611 | 10/1995 | WIPO . |

*Primary Examiner*—Laurie K. Cranmer
*Attorney, Agent, or Firm*—Morrison Law Firm

[57] ABSTRACT

An office chair seat carrier includes a seat platform carrier and a back rest carrier pivotally connected about parallel rotatable axes to a carrier part. A stack of lamellar disks is pivotally connected between the carrier part, seat platform carrier, and back rest carrier for holding the carriers in place by frictional contact. The stack of lamellar disks is linked with a holding member rigidly attached to the carrier part. Frictional contact is established by activating an actuator lever which slides a clamping member against the stack of lamellar disks. The clamping member applies a lateral clamping force upon the stack of lamellar disks forcing the disks together. Frictional contact is broken only after the actuator lever releases the clamping force and a mechanical force is exerted on the seat platform carrier or back rest carrier.

53 Claims, 12 Drawing Sheets

OFFICE CHAIR SEAT CARRIER

BACKGROUND OF THE INVENTION

This invention relates to office chair seat carriers. More particularly, the invention relates to seat carriers that prevent the unexpected movement of seat platforms, and the springing forward of back rests in an undesirable fashion possibly injuring seated persons.

Conventional office chair seat carriers are well known. Generally, office chair seat carriers consist of a carrier part connected with a support column, a seat platform carrier, and a back rest carrier. Such a device is described in prior art reference EP-A-O 198 056.

Prior art reference EP-A-O 198 056 discloses a seat carrier for office chairs, including a carrier part connected to a support column, a seat platform carrier, and a back rest carrier. The seat platform carrier and the back rest carrier are connected with the carrier part so that all three pivot about a rotating axis. A pre-stressed spring is connected between the carrier part and the seat platform carrier.

Arranged between the seat platform carrier, the back rest carrier, and the carrier part is a stack of lamellar disks. Slots in the lamellar disks provide for longitudinal and vertical movement between the three carriers. The lamellar disks are pivotally mounted to the back rest carrier and linked with a cross bolt. The cross bolt is rigidly mounted to the lateral walls of the carrier part.

According to this disclosure, a clamping force can be applied to the lamellar disks to set a desired position of the seat platform carrier and the back rest carrier. The clamping force acts laterally upon the lamellar disks. This clamping force presses the lamellar disks together, fixing the positions of the seat platform carrier and the back rest carrier. An actuator lever is provided for applying or releasing such force. However, the seat platform and back rest carrier are prone to sudden movements resulting from imprecision in releasing the clamping force via the actuator lever.

Another prior art reference is German Patent No. DE 40 14 154 A1. This reference relates to a seat carrier that enables mutual adjustment of the incline of a seat platform and a back rest of an office swivel chair. The desired position is achieved by frictional contact between holding members. An actuator lever acts on an axial sliding clamping bolt and spring arrangement, so that the clamping bolt comes into contact with the holding members. The clamping force presses the holding members together, fixing the seat platform and back rest in place.

According to this prior art reference, the seat carrier includes a tapered link that acts axially in the direction of the clamping bolt. The link interacts with the actuator lever in such a way that a pressure point is exceeded and the clamping bolt slides when the actuator lever is pivoted. The actuator lever is thus used to apply or release the clamping force exerted on the holding members. An advantage of this invention is that the locking position and the release position can be set without the necessity of keeping the user's hand on the actuator lever.

The problem with the prior art references is that sudden movement of the seat platform or back rest can occur from accidentally or intentionally adjusting the actuator lever. This unexpected jerking movement of the seat platform or back rest can cause injuries to a seated person or a person near the seated position. In the case of a back rest without load, the back rest can unexpectedly spring forward when the actuator lever is accidentally or intentionally adjusted.

OBJECTS AND SUMMARY OF THE INVENTION

It is an object of the present invention to overcome the drawbacks and limitations of the prior art.

It is another object of the present invention to provide a seat carrier that prevents sudden springing forward of back rests.

It is another object of the present invention to provide a clamping mechanism that maintains frictional contact between holding members when an actuator lever is adjusted to hold a seat platform and a back rest in place. The frictional contact is released only when pressure is exerted on the seat platform carrier or back rest carrier. Thus the seat platform and back rest are adjustable in a controlled manner.

It is a further object of the present invention to provide a simple cost effective arresting mechanism for predictably and reliably preventing sudden movements in office chairs.

Briefly stated, an office chair seat carrier includes a seat platform carrier and a back rest carrier pivotally connected about parallel rotatable axes to a carrier part. A stack of lamellar plates and disks is pivotally connected between the carrier part, seat platform carrier, and back rest carrier for holding the carriers in place by frictional contact. The stack of lamellar disks is linked with a holding member rigidly attached to the carrier part. The disks are placed between pairs of adjacent lamellar plates. Frictional contact is established by activating an actuator lever which slides a clamping member against the stack of lamellar plates. The clamping member applies a lateral clamping force upon the stack of lamellar plates forcing the plates and disks together. Frictional contact is broken only after the actuator lever releases the clamping force and then after a mechanical force is exerted on the seat platform carrier or back rest carrier.

According to an embodiment of the present invention, there is disclosed, a seat carrier, comprising a first part with a first friction element, a second part with a second friction element adjacent said first friction element, said first and second parts being movably interconnected, first means for urging said first part with respect to said second part, a holding element movably connected to said first part with at least a portion thereof adjacent said first friction element, a releasable actuator element pressing said first friction element against said second friction element, whereby a first force of friction is generated between said first friction element and said second friction element, said first force of friction being sufficient to prevent said first means for urging from moving said first part with respect to said second part, said holding element being forced against at least one of said first and second friction elements by said force of said first means for urging to generate a second force of friction between said holding element and said at least one of said first and second friction elements, said holding element being in a holding position effective to prevent a movement of said first friction element away from said second friction element, and said second force of friction being effective to maintain said holding element in said holding position, whereby said first friction element continues to be pressed against said second friction element after said actuator element is released, whereby said first force of friction is maintained.

According to another embodiment of the present invention, there is disclosed, a seat carrier, comprising a seat base, a seat back movably connected to said seat base, first means for urging said seat back in a first direction with respect to said seat base,.a first friction element connected to said seat back, a second friction element connected to said seat base, said first and second friction elements having first and second adjacent surfaces, respectively, at least one of said first and second friction elements having a third surface, a holding element connected to one of said seat back and said seat base, said holding element having a fourth surface adjacent said third surface, second means for urging said holding element in a second direction against said first friction elements toward said second friction element, whereby said first and second surfaces are urged against each other to generate a first force of friction, said second means for urging being such that said first force of friction is sufficient to prevent said first means for urging from moving said seat back in said first direction with respect to said seat base, and said first means for urging including means for pressing said third surface against said fourth surface generating a second force of friction that prevents said holding element from moving when said second means for urging is removed, such that said first force of friction is maintained.

According to a further embodiment of the present invention, there is disclosed, a seat carrier, comprising a seat base, a seat back movably connected to said seat base, first means for urging said seat back in a first direction with respect to said seat base, a locking mechanism, said locking mechanism movably connected to said seat base and said seat back, a holding member connecting said locking mechanism to said seat base, said locking member including at least first and second friction elements, means for applying and releasing a clamping force on said locking member, said clamping force creating a first frictional force between said at least first and second friction elements, said first frictional force being effective to hold a position of said seat base and said seat back with respect to each other, said first means for urging including means for pressing said holding member against said at least first and second friction elements generating a second frictional force, and said second frictional force being effective to maintain said first frictional force after said clamping force is released.

According to yet another embodiment of the present invention, there is disclosed, a seat carrier, comprising a first seat element having a first friction element, a second seat element having a second friction element, a spring connected between said first and second seat elements such that said spring urges said first seat element in a direction relative to said second seat element, a holding member, said holding member being connected to said first friction element such that said holding member moves with said first friction element relative to said second friction element, means for gripping said first friction element by squeezing said first friction element between said second friction element and another member, and means for moving said holding member to a position such that said holding member is in a blocking position effective to block a movement of said first element relative to said second element required to release a grip of said first friction element, said holding member being positioned such that said spring presses said holding member against said holding member when said first friction element is gripped, said pressing generating a friction effect to keep said holding member in said blocking position, whereby said grip of said first friction element continues after a disengagement of said means for gripping.

According to the invention, a cross bolt which links a stack of lamellar disks is mounted in a sleeve that passes through the stack of lamellar disks. The sleeve is slidably arranged along the axis of the cross bolt and on the side of the stack of lamellar disks that absorbs a clamping force. The sleeve has a flange that presses against the stack of lamellar disks. Pressing against the other side of the stack, is a head of the cross bolt.

A clamping mechanism for applying the clamping force engages the flange of the sleeve pressing it firmly against the stack of lamellar disks. When the clamping force is released, the flange remains connected with the stack of lamellar disks through frictional contact. Only a releasing motion through pressure on the seat platform carrier or back rest carrier separates the flange from the lamellar stack and the individual lamellar disks from each other. It is advantageous to include a pressure spring and a bearing/stop collar between the head of the cross bolt and the flange of the sleeve. This configuration of cross bolt, bearing/stop collar, pressure spring, and flanged sleeve provides reliable separation when the clamping force is released.

According to the invention, the clamping mechanism is a clamping bar or clamping disc connected to an actuator lever. A swivel motion of the actuator lever is translated into a rotating motion of the clamping mechanism. In the area where the clamping mechanism and sleeve flange interact are clamping tapers that engage to provide the clamping force.

According to a first embodiment of the invention, a clamping bar is arranged in the carrier part of the office chair seat carrier. The clamping bar is slidable by means of an actuator lever. At the end of the clamping bar is a first clamping taper turned toward a flange. At the end of the cross bolt and outside the flange is a clamping part. The clamping part is axially movable on the cross bolt. The clamping part is arranged with a second clamping taper that matches the first clamping taper. Sliding the two clamping tapers against each other in one direction causes the application of a force upon the flange and stack of lamellar disks. The application of this force causes frictional contact between the flange, lamellar disks, and cross bolt head. This frictional contact secures the positions of the seat platform carrier and the back rest carrier. Disengaging the clamping bar allows the clamping force to be broken.

According to a second embodiment of the invention, the flange includes a spirally ascending clamping taper. The clamping mechanism is pivotally arranged in the carrier part of the seat carrier. On one side, the clamping mechanism has a clamping taper that corresponds to the clamping taper of the flange, while on the other side, the clamping mechanism is connected to an actuator lever mounted in the carrier part and movable from the outside by a seated person.

According to a third embodiment of the invention, the clamping mechanism is rotatable horizontally and transversely with respect to the flange in the carrier part of the seat carrier. The rotatable clamping mechanism in the flange area includes a section eccentric to the rotating axis connected to an actuator lever mounted in the carrier part. The actuator lever is movable from the outside by a seated person.

It is advantageous to have the sleeve of the cross bolt acted on by a pressure spring. The force of this pressure spring must be such that it does not overcome the holding force of the compressed lamellar stack when the clamping mechanism is disengaged. The pressure spring must also be such that it separates the flange from the lamellar stack, releasing the individual lamellar disks only when mechanical action is applied to the lamellar stack. For example, by pushing the seat platform carrier connected with the lamellar stack or by leaning against the back rest also connected to the lamellar stack.

It is additionally advantageous to include a bearing/stop collar arranged between the head of the cross bolt and the pressure spring acting upon the sleeve. A cup spring and lock washer can also be added between the flange and stack of lamellar disks to provide improved reliability.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
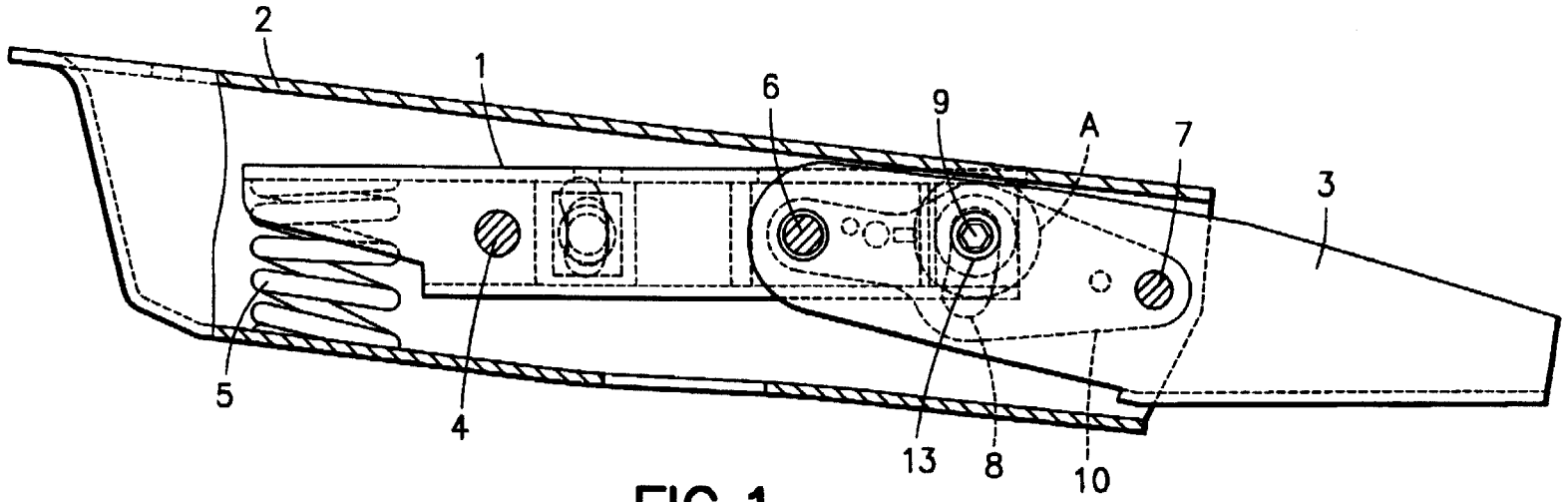
FIG. 1 is a side view of a seat carrier in a first position according to a first embodiment of the present invention.
Figure 2:
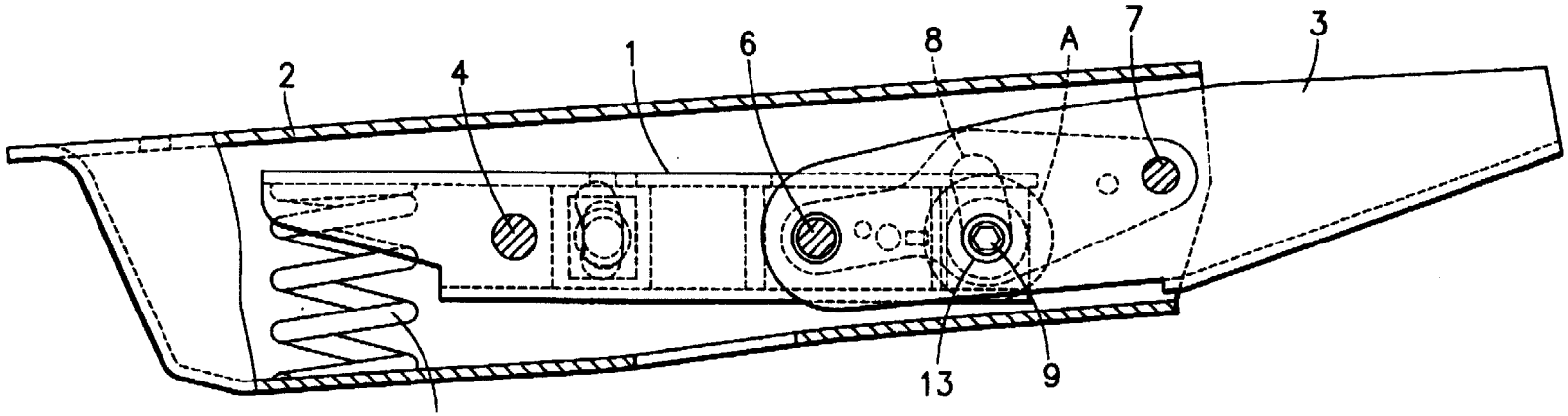
FIG. 2 is a side view of the seat carrier shown in FIG. 1 in a second position.
Figure 3:
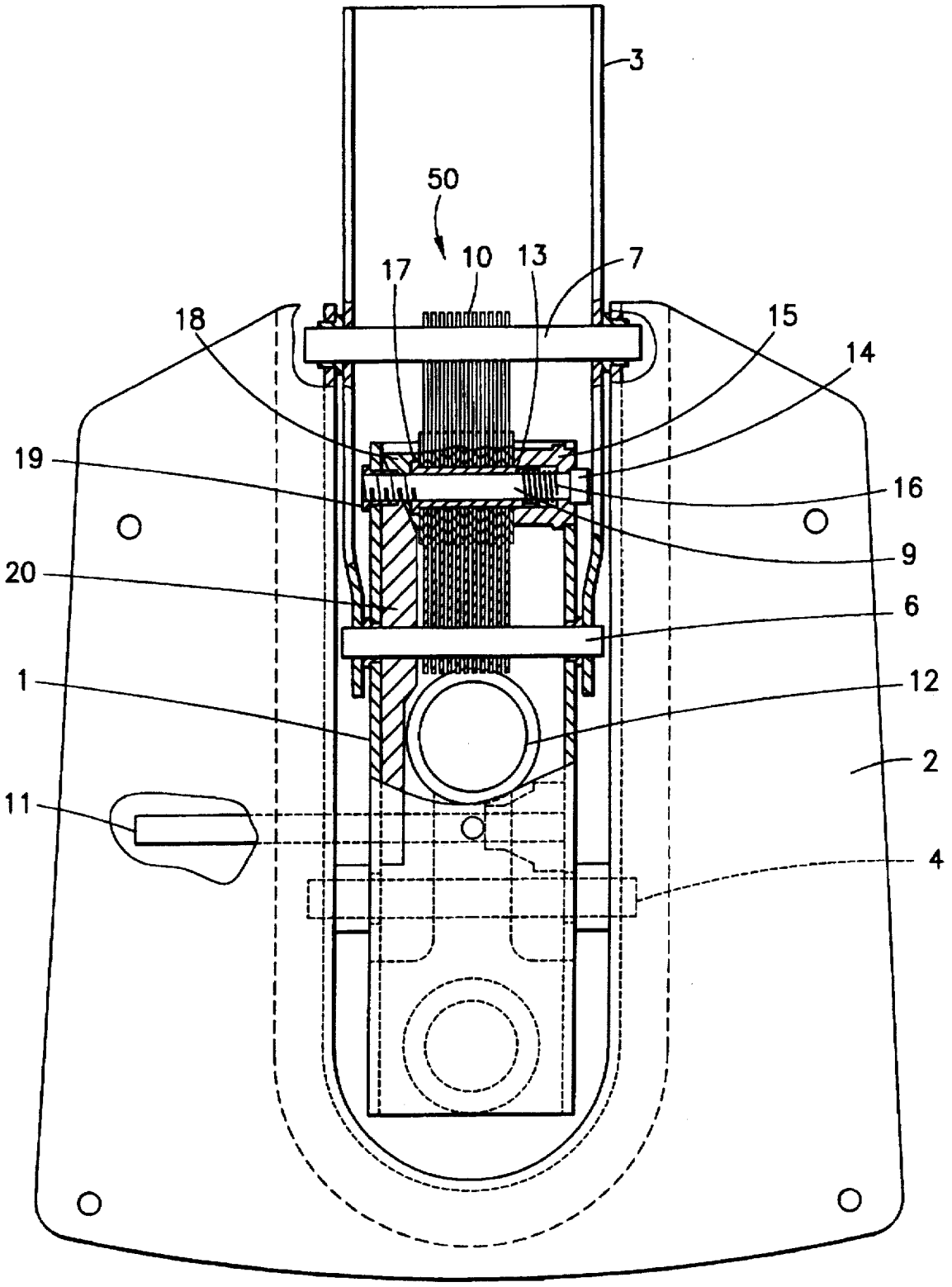
FIG. 3 is a top view of the seat carrier shown in FIGS. 1–2.

Referring to FIGS. 1–3, an office chair seat carrier includes a carrier part 1 connected by a cross bolt 4 to a seat platform carrier 2 to permit pivoting about a first axis. Carrier part 1 is also connected to a back rest carrier 3 by a cross bolt 6 to pivot about a second axis. Lateral walls of carrier part 1, seat platform carrier 2, and back rest carrier 3 partially overlap (FIG. 3). Each of carrier part 1, seat platform carrier 2, and back rest carrier 3 is, at least partly, U-shaped in cross-section. Carrier part 1 is mounted on a support column 12 (FIG. 3). Seat platform carrier 2 is connected to back rest carrier 3 by a cross bolt 7 to pivot about a third axis. A pre-stressed pressure spring 5 urges carrier part 1 and seat platform carrier 2 in opposite directions about the first axis. Because back rest carrier 3 and carrier part 1 are pivotally linked, carrier part 1 and back rest carrier 3 are urged to pivot in opposite directions about the first and third axes, respectively, with respect to seat platform carrier 2. From the frame of reference of carrier part 1, the part that is actually fixed with respect to support column 12, seat platform carrier 2 and back rest carrier 3 are urged to pivot oppositely about the first and third axes, respectively.

Lamellar plates 10, between the respective sidewalls of carrier part 1, seat platform carrier 2, and back rest carrier 3, are pivotally connected, at one end of lamellar plates 10, to seat platform carrier 2 and back rest carrier 3 by cross bolt 7. Opposite ends of lamellar plates 10 are pivotally connected to carrier part 1 and back rest carrier 3 by cross bolt 6. A holding bolt 9 supported in holes in the lateral walls of carrier part 1 passes through slots 8 in lamellar plates 10. Holding bolt 9 fits closely in a coaxial cylindrical sleeve 13 that also passes through slots 8 (shown in FIGS. 1 and 2) in lamellar plates 10. Slots 8 are located approximately in the middle of the elongated lamellar plates 10. When seat platform carrier 2 and back rest carrier 3 pivot oppositely about the first and third axes, respectively, holding bolt 9 with sleeve 13 move up and down within slots 8. A lamellar disk A fits between each adjacent pair of lamellar plates 10 forming a lamellar stack 50. Lamellar disks A each have a circular hole through which sleeve 13 and holding bolt 9 passes. Thus, when seat platform carrier 2 and back rest carrier 3 pivot oppositely about the first and third axes, respectively, holding bolt 9 with sleeve 13, lamellar disks A move with holding bolt 9 and sleeve 13 sliding along the adjacent lamellar plates 10.

The pivoting motion described above permits adjustment of an angle of seat platform carrier 2 and back rest carrier 3 relative to carrier part 1. The relative movement between the three carriers can be seen by comparing FIGS. 1 and 2.

Figure 4:
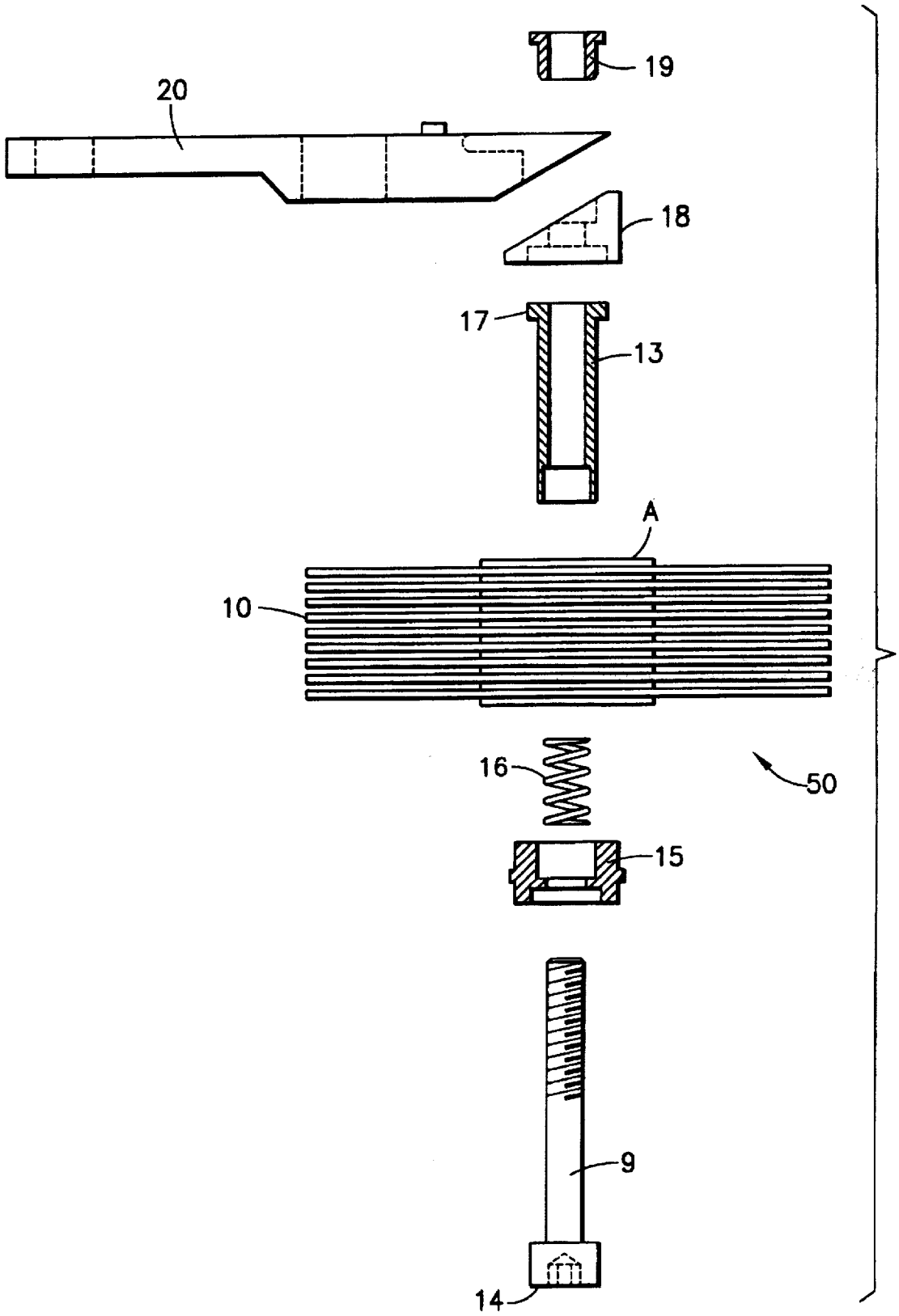
FIG. 4 is an exploded view of the clamping mechanism of the seat carrier shown in FIGS. 1–3.

Referring now to FIG. 4, a clamping mechanism according to a first embodiment is shown. The clamping mechanism includes a sleeve 13 passing through slots 8 arranged in the stack of lamellar plates 10. One end of sleeve 13 has a flange 17 which bears rigidly against the stack of lamellar plates 10 when clamping bar 20 is in a clamping position. Clamping bar 20 acts with a clamping taper upon a clamping part 18. Clamping part 18 includes a clamping taper that matches the clamping taper of clamping bar 20. When clamping bar 20 acts upon clamping part 18 a lateral clamping force is exerted upon flange 17 forcing it against the stack of lamellar plates 10.

Sleeve 13 and clamping part 18, adjacent flange 17 of sleeve 13, slide axially on holding bolt 9. Holding bolt 9 is held in place by an insert nut 19 on the side of carrier part 1. On the other side of lamellar stack 50 a bearing/stop collar 15, supported by holding bolt 9, is urged away from sleeve 13 by a weak pressure spring 16. When a clamping force is applied to flange 17, lamellar stack 50 is squeezed between bearing/stop collar 15 and flange 17, bearing/stop collar 15 being supported by head 14 of holding bolt 9.

When a lateral clamping force is applied to lamellar stack 50, lamellar plates 10 and lamellar disks A are pressed together. The pivoting motion discussed above that permits the seat back (not shown) to pivot with respect to carrier part 1 is resisted by this pressing because of friction between lamellar plates 10 and lamellar disks A. The friction effectively locks the seat back's position with respect to carrier part 1 when lamellar stack 50 is squeezed by the lateral clamping force.

When clamping bar 20 is released from clamping part 18, the lateral force that squeezes lamellar stack 50 is not immediately released. The frictional contact between lamellar disks A and lamellar plates 10 supplies a primary frictional force that opposes pressure spring 5. This primary frictional force is maintained after clamping member ,20 is released from clamping part 18.

To create the primary frictional force that resists the motion of the seat back, a shear force of friction across the interfaces of lamellar disks A and lamellar plates 10 is generated by a normal force applied against the surfaces of lamellar plates 10 and lamellar disks A. This force must be maintained after clamping bar 20 releases clamping part 18 for the primary frictional force across the surfaces of lamellar disks A and lamellar plates 10 to be maintained.

A secondary (normal) frictional force holds sleeve 13 in position within lamellar plates 10 and lamellar disks A. This secondary frictional force is a result of pressure spring 5, which always presses lamellar plates 10 toward one side of sleeve 13. Secondary friction is also generated between the inner side of sleeve 13 and bolt 9. These secondary frictional forces keep sleeve 13 from moving sufficiently, with respect to bearing/stop collar 15, to relieve the lateral squeezing. This maintains the primary friction that prevents pressure spring 5 from pivoting seat platform carrier 2 and back rest carrier 3 oppositely about the first and third axes, respectively. Thus, the seat back stays in the position in which it was clamped until the seat back is forcibly moved by a user. The forcible movement of the seat back causes adjacent lamellar plates 10 and lamellar disks A to move away from sleeve 13, relieving the secondary friction that keeps sleeve 13 in place. Thus, when clamping bar 20 is released, the seat back remains in position unless the seat back is forced to move, unlike the prior art mechanism in which the seat back springs under the urging of a large spring when the prior art clamp is released.

Lamellar plates 10, collar 15, and holding bolt 9 abut a wall of carrier part 1. Collar 15 and flange 17 are on opposite sides of lamellar plates 10 supplying the squeezing force that generates the primary friction between lamellar disks A and lamellar plates 10. In order to relieve the primary frictional force, the squeezing force must be relieved. To relieve the squeezing force, collar 15 and flange 17 must be separated further apart. To separate collar 15 and flange 17, sleeve 13 must slide within the space formed by the holes in lamellar disks A and lamellar plates 10 (actually, slots 8) since, as described above, sleeve 13 must move relative to lamellar disks A and lamellar plates 10 to relieve the squeezing force.

The frictional force tending to hold sleeve 13 in the space is governed by the static coefficient of friction between sleeve 13 and lamellar disks A and lamellar plates 10 and between the inner side of sleeve 13 and holding bolt 9. When the seat back is forcibly moved against the force of pressure spring 5, the normal force perpendicular to the lateral direction (the direction of the axis of holding bolt 9) is relieved, eliminating the secondary friction that holds sleeve 13 in place.

When the secondary friction is released, weak pressure spring 16 urges sleeve 13 away from collar 15. If there was no lateral friction between sleeve 13 and lamellar plates 10 and between sleeve 13 and holding bolt 9, the lamellar plates 10 would loosen immediately following the release of clamping member 18. Weak spring 16 would force sleeve 13 out of lamellar disks A and lamellar plates 10. According to the above description, weak spring 16 must wait until the secondary frictional force is relieved to move sleeve 13 out of lamellar disks A and lamellar plates 10.

Therefore, sleeve 13, lamellar disks A and lamellar plates 10, and holding bolt 9 must be made of suitable materials that provide a static coefficient of friction between the outside of sleeve 13 and the walls of the space in lamellar disks A and lamellar plates 10 to engage sleeve 13. Materials with great strength, such as steel or plastic materials with enforced glass fibers, must be used to create the necessary frictional contact. The space in lamellar disks A and lamellar plates 10 through which sleeve 13 passes must also be sized appropriately. A 0.1 mm tolerance, for example, is suitable between the diameter of sleeve and the holes in disks A. In addition weak spring 16 must be chosen so that the force applied by it is too weak to overcome the static friction holding sleeve 13 in the space within lamellar disks A and lamellar plates 10 and strong enough to force sleeve 13 out of slot 8 when the secondary frictional force is released by a mechanical action is applied to seat back carrier 3.

Figure 5:
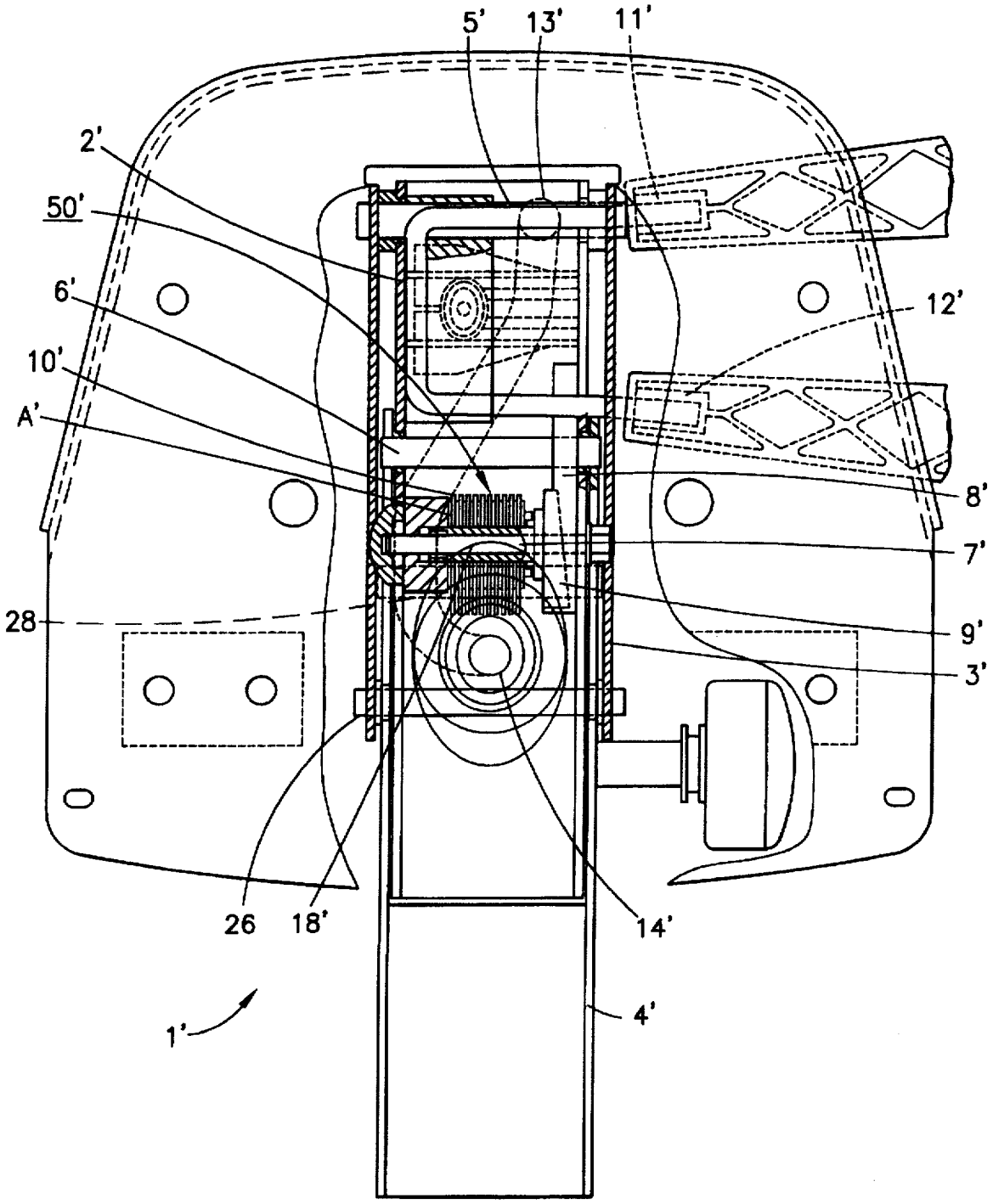
FIG. 5 is a top view of a seat carrier according to a second embodiment of the present invention.
Figure 6:
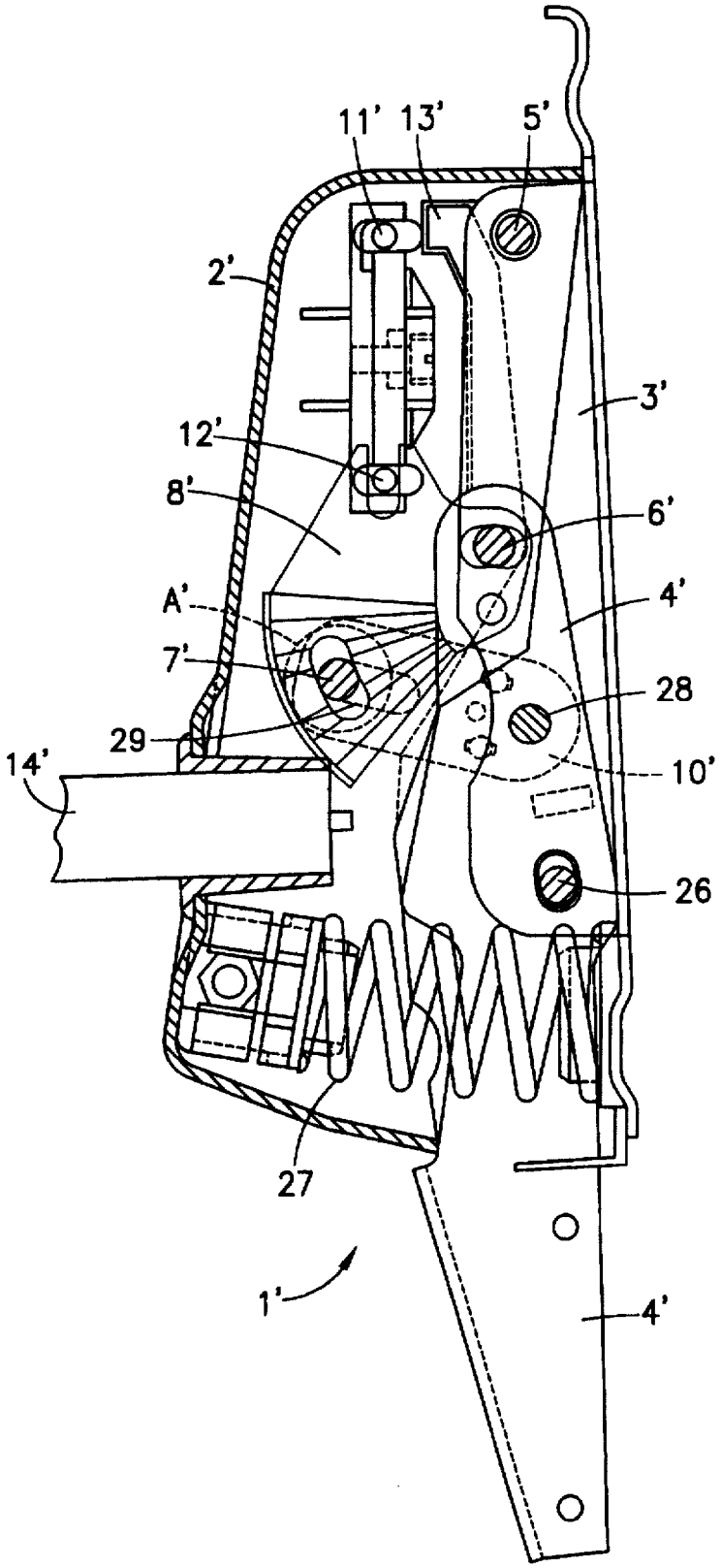
FIG. 6 is a side view of the seat carrier shown in FIG. 5 in a first position.
Figure 7:
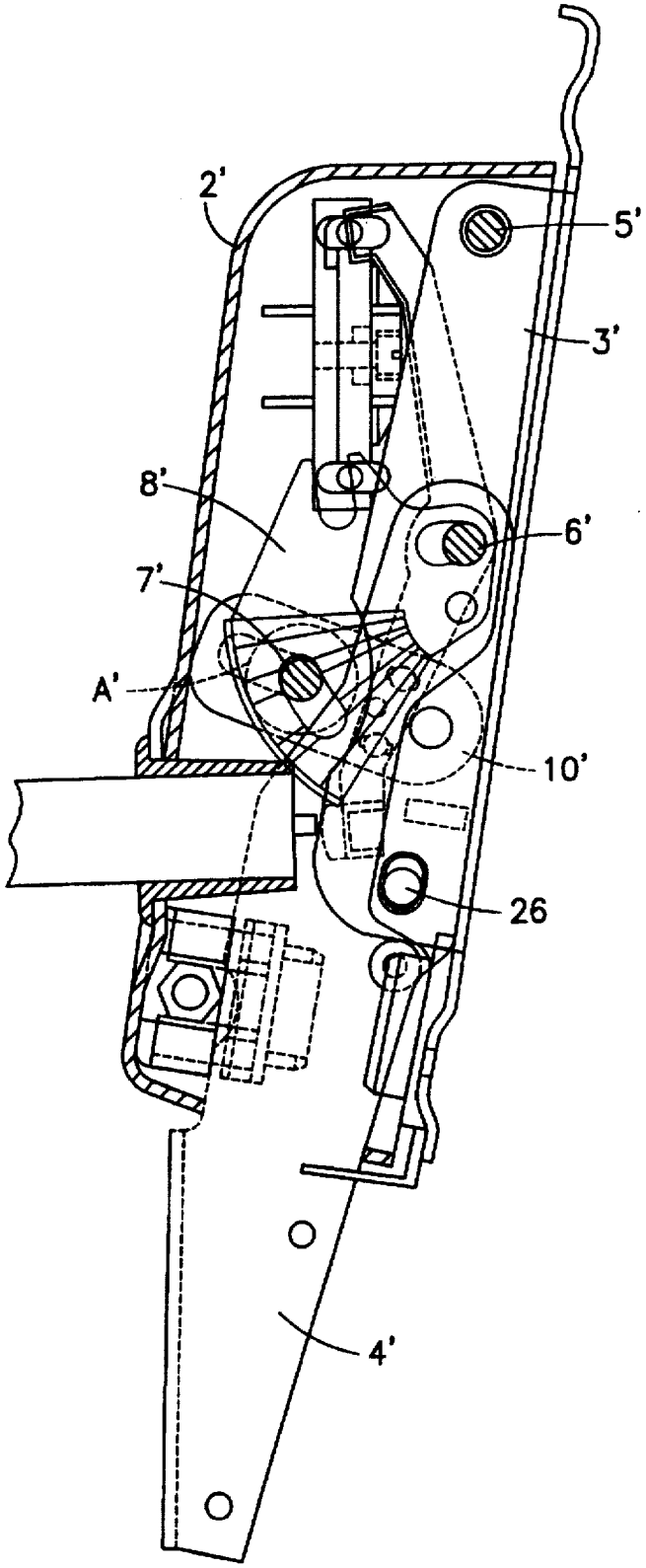
FIG. 7 is a side view of the seat carrier shown in FIGS. 5–6 in a second position.

Referring now to FIGS. 5–7, a seat carrier 1', according to a second embodiment of the present invention, includes a carrier part 2' pivotally connected by cross bolt 5' about a first axis to a seat platform carrier 3'. A spring 27 urges carrier part 2' and seat platform carrier 3' in opposite directions about the first axis. Carrier part 2' is also connected to back rest carrier 4' by a cross bolt 6' to pivot about a second axis. Seat platform carrier 3' is connected to back rest carrier 4' by a cross bolt 26 to rotate about a third axis. This connection by cross bolt 26 also allows movement between seat platform carrier 3' and back rest carrier 4'. The lateral walls of carrier part 2', seat platform carrier 3', and back rest carrier 4' partially overlap (FIG. 5). The three carriers are also at least partly of U-shaped cross-section. Carrier part 2' is rigidly mounted on a support column 14' with a gas spring (not shown).

The relative movement of the three carriers is shown in FIGS. 6 and 7. The up and down movement of seat platform carrier 3' with back rest carrier 4' is designed to prevent the so-called "shirt pullout" effect. The relative movement takes place against the force of spring 27 between seat platform carrier 3' and carrier part 2' in one direction and with the force of spring 27 in an opposite direction.

Referring now specifically to FIG. 5, lamellar plates 10', between carrier part 2' and back rest carrier 4', are pivotally connected, at one end of lamellar plates 10', to carrier part 2' and back rest carrier 4' by a cross bolt 28. Opposite ends of lamellar plates 10' are pivotally connected with a holding bolt 7' supported by the lateral walls of carrier part 2'. Holding bolt 7' fits closely in a coaxial non-rotating sleeve 18' that passes through slots 29 in lamellar plates 10'. When seat platform carrier 3' and back rest carrier 4' pivot about first and second axes, respectively, holding bolt 7' with sleeve 18' move up and down within slots 29. A lamellar disk A fits between each adjacent pair of lamellar plates 10' forming a lamellar stack 50'. Lamellar disks A each have a hole through which sleeve 18' and holding bolt 7' passes. Thus, when seat platform carrier 3' and back rest carrier 4' pivot about first and second axes, respectively, lamellar disks A move with holding bolt 7' and sleeve 18', sliding along the adjacent lamellar plates 10'.

The location of holding bolt 7' and sleeve 18' within slots 29 determines the positions of seat platform carrier 3' and back seat carrier 4'. These positions can be held by squeezing lamellar stack 50' and creating the primary frictional force between lamellar plates 10' and lamellar disks A discussed above in the first embodiment. For the purpose of squeezing lamellar stack 50', sleeve 18' has a flange 9' with a spirally ascending clamping taper attached. This clamping taper engages with a matching clamping taper 17' of a clamping mechanism 8' pivotally mounted on carrier part 2'. Clamping mechanism 8' is connected to an actuator lever 12'. The actuator lever 12' engages and releases the clamping tapers of clamping mechanism 8' and flange 9'. When the clamping tapers are engaged, lamellar plates 10' and lamellar disks A are pressed together, creating primary frictional force, and the positions of seat platform carrier 3' and back rest carrier 4' are locked. A second actuator lever 11' acts upon the gas spring in support column 14 via a reversing arm 13'.

Figure 8:
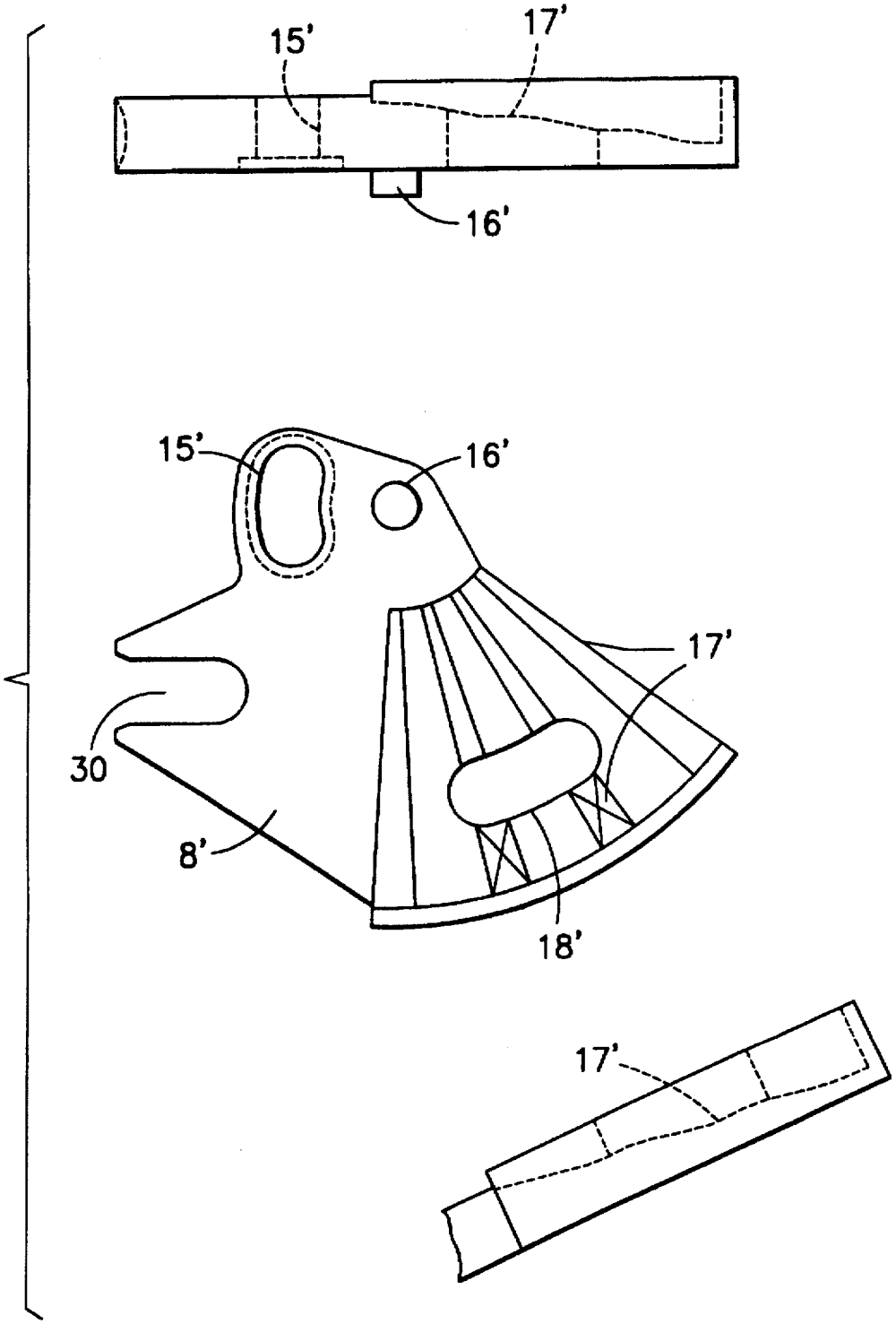
FIG. 8 is an exploded view of the clamping elements of the seat carrier shown in FIGS. 5–7.

Referring now also to FIG. 8, clamping mechanism 8' is pivotally mounted to carrier part 2' by inserting a neck 16' into a hole of carrier part 2'. Clamping mechanism 8' includes a clamping taper 17' at one end consisting of several tapered steps. At the other end of clamping mechanism 8', a recess 30 engages actuator lever 12'. By means of actuator lever 12', clamping mechanism 8' can be rotated about neck 16'. Cross bolt 6' passes through a hole 15' in clamping mechanism 8' to hold clamping mechanism 8' in place, together with carrier part 2' and back rest carrier 4'.

Figure 9:
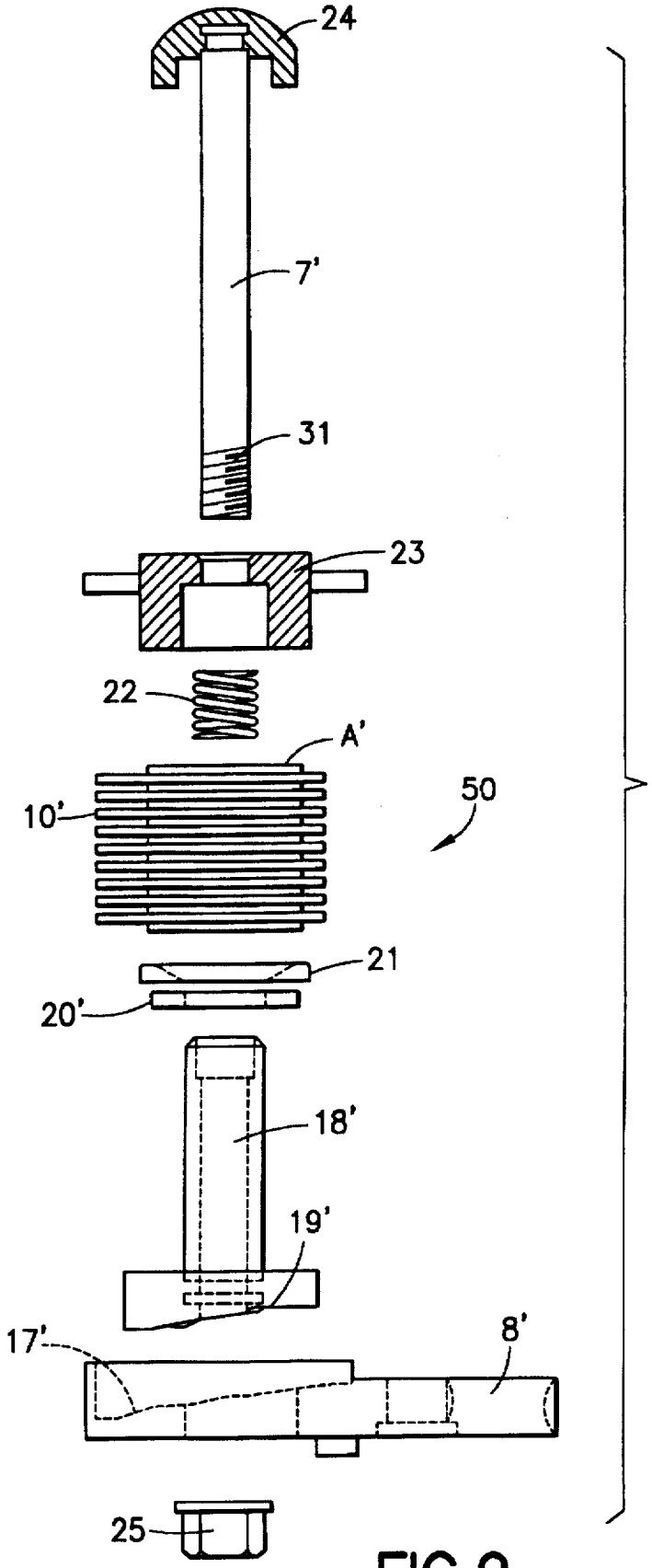
FIG. 9 is an exploded view of the clamping mechanism of the seat carrier shown in FIGS. 5–7.

Referring now also to FIG. 9, holding bolt 7' includes a head 24 on one end and threads 31 on the other end. Holding bolt 7' is held in place by a nut 25 on the side of carrier part 2'. A sleeve 18' slides axially on holding bolt 7' in a fixed rotational position. Sleeve 18' passes through slots 29 of lamellar disks 10'. Sleeve 18' includes a flange 19' at one end. A washer 20' slides over sleeve 18' and abuts flange 19'. On the other side of washer 20' a cup spring 21 bears flatly against lamellar stack 50'.

A spirally ascending clamping taper is attached to the free side of flange 19'. This clamping taper engages with clamping taper 17' of clamping mechanism 8'. On the side of lamellar stack 50' opposite flange 19', a bearing/stop collar 23, supported by holding bolt 7', is urged away from sleeve 18' by a weak pressure spring 22.

Clamping taper 17' engages with the clamping taper on flange 19' and presses flange 19' against washer 20', cup spring 21, and lamellar stack 50'. In addition, bearing/stop collar 23 presses against head 24 of holding bolt 7'. Lamellar stack 50' is squeezed between bearing/stop collar 23 and flange 19'. The pivoting motion discussed above that permits the seat back (not shown) to pivot with respect to carrier part 2' is resisted by this squeezing because of primary frictional force between lamellar plates 10' and lamellar disks A. The primary frictional force effectively locks the position of seat platform carrier 3' and back rest carrier 4' with respect to carrier part 2' when lamellar stack 50' is squeezed.

When the clamping tapers are released, a secondary frictional force between lamellar stack 50' and sleeve 18', as described above, maintains the primary frictional force between lamellar plates 10' and lamellar disks A. The primary frictional force is not immediately broken if there is a sufficient number of lamellar plates 10' in lamellar stack 50'. A sufficient number of lamellar plates 10' is considered to be at least 15 but preferably more than 20. The remaining primary frictional force between lamellar plates 10' and lamellar disks A prevents the back rest from springing forward when the actuator lever is handled accidentally. Weak pressure spring 22 facilitates the breaking of the secondary frictional force between sleeve 18' and lamellar stack 50'. Secondary frictional force is broken only after a mechanical force such as pressure exerted on the seat surface or back rest acts upon the lamellar plates 10' to overcome the force of pressure spring 27 and when weak pressure spring 22 supports the release of sleeve 18' from lamellar stack 50'.

The force of weak pressure spring 22 must be such that it does not overcome the secondary frictional force of the compressed lamellar stack 50' on sleeve 18' when the clamping tapers are disengaged. Weak pressure spring 22 must also separate flange 19' from lamellar stack 10', releasing the individual lamellar disks A only when a mechanical action is applied to lamellar stack 50'.

Figure 10:
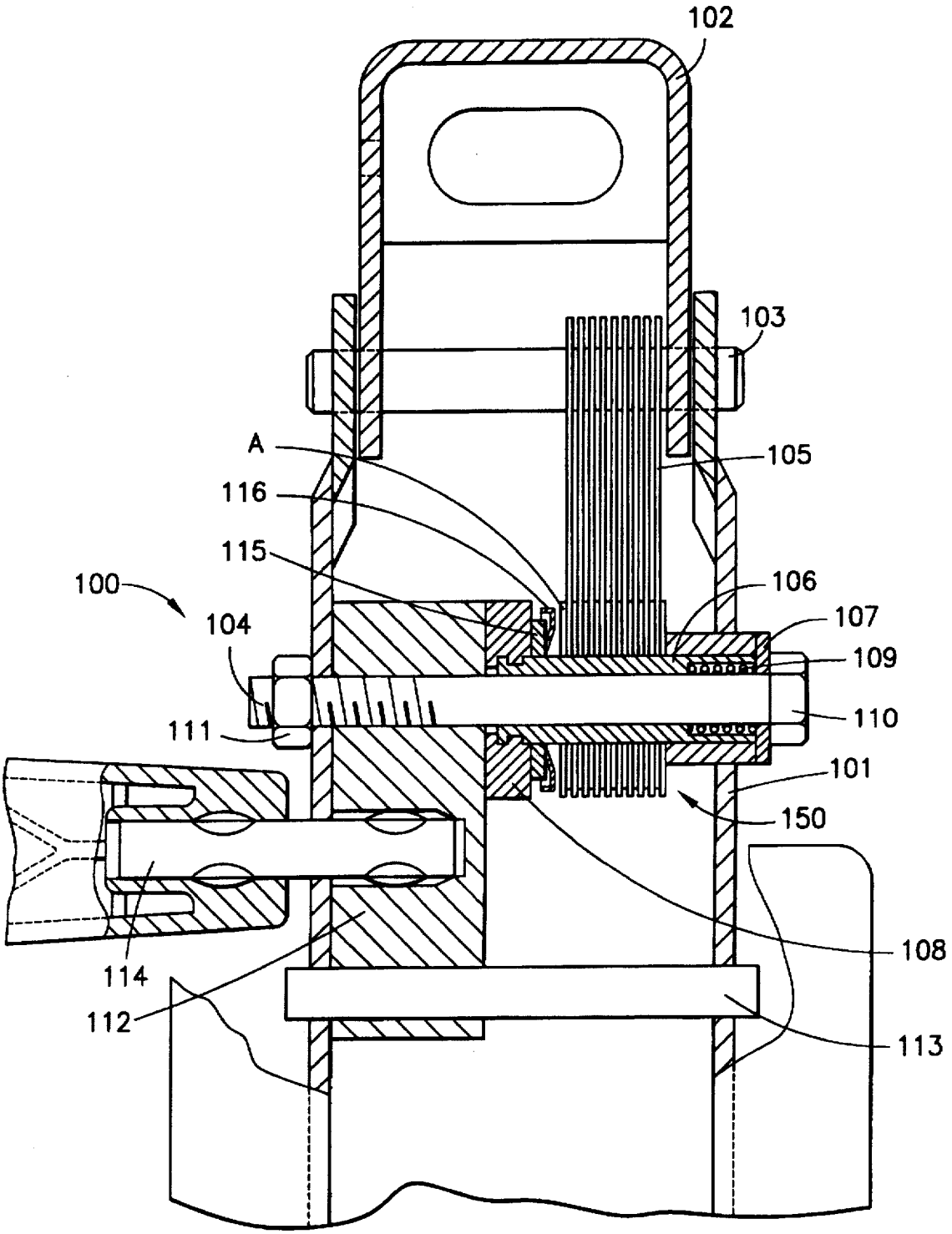
FIG. 10 is a partial top view of a seat carrier according to a third embodiment of the present invention.

Referring now to FIGS. 10–14, an office chair seat carrier 100 according to a third embodiment of the present invention includes a carrier part 101 pivotally connected to a back rest carrier 102 by a cross bolt 117 (not shown in FIGS. 10–12) about a first axis. Each of carrier part 101 and back rest carrier 102 is, at least partly, U-shaped in cross-section. Lateral walls of carrier pan 101 and back rest carrier 102 partially overlap (FIG. 10).

Figure 13:
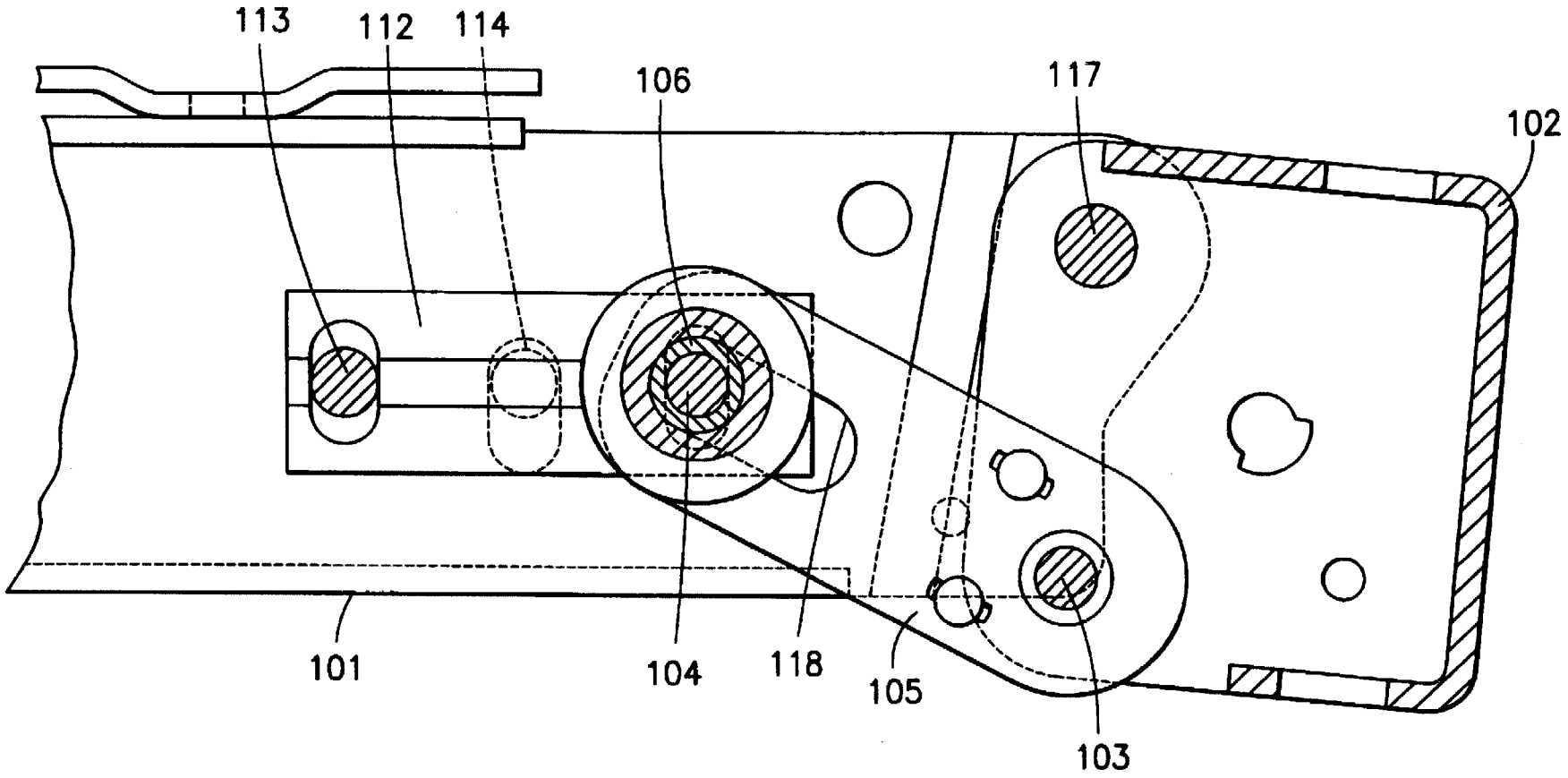
FIG. 13 is a side view of the seat carrier shown in FIG. 10 in a first position.
Figure 14:
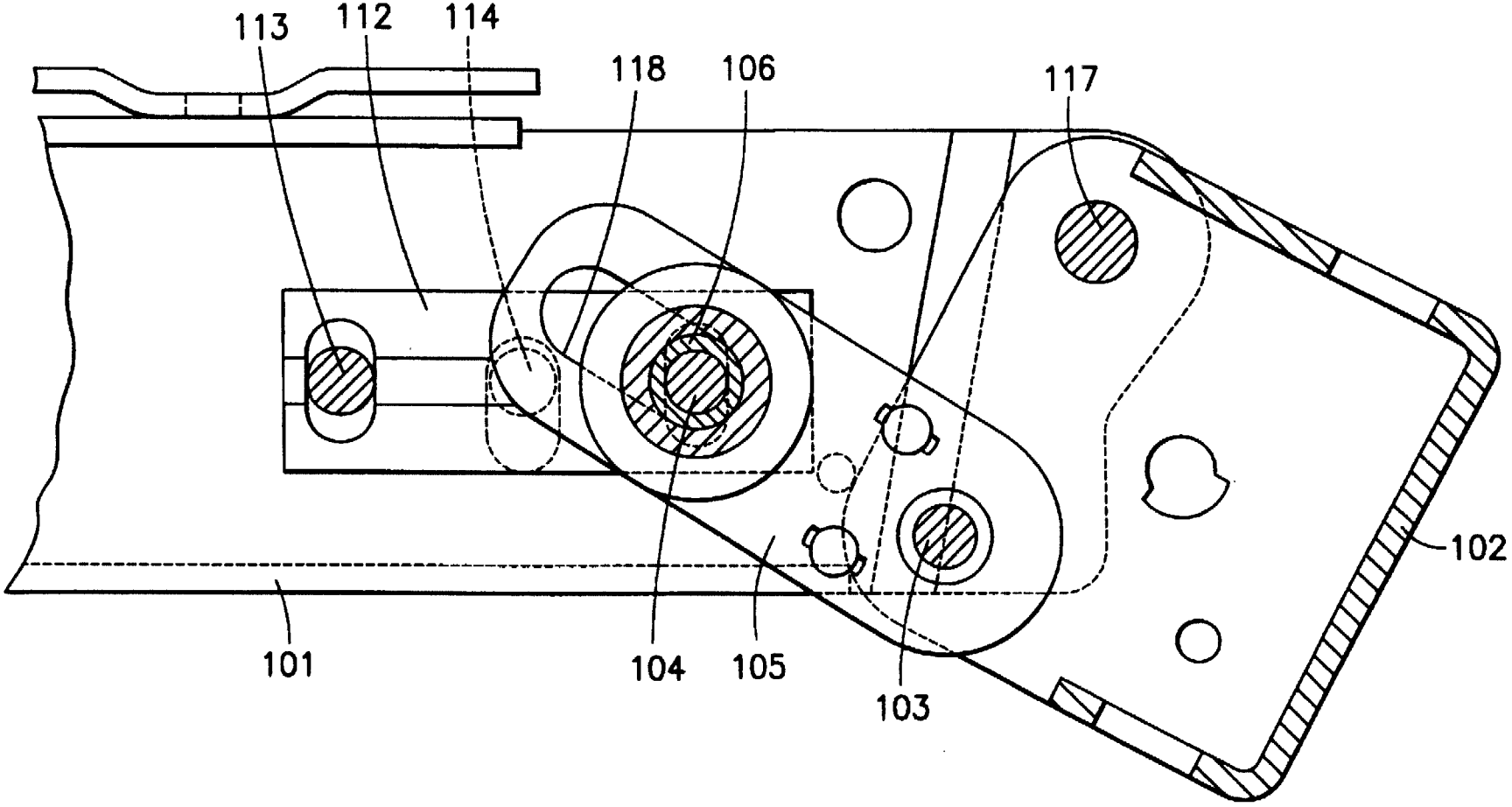
FIG. 14 is a side view of the seat carrier shown in FIG. 10 in a second position.

Referring now specifically to FIGS. 10 and 13–14, lamellar plates 105, between respective lateral wafts of carrier part 101, and back rest carrier 102 are pivotally connected, at one end of lamellar plates 105, to back rest carrier 102 by a cross bolt 103. Opposite ends of lamellar plates 105 are pivotally connected by a holding bolt 104 to carrier part 101. Holding bolt 104 is supported in holes in the lateral walls of carrier part 101. Holding bolt 104 fits closely in a coaxial cylindrical sleeve 106 that passes through slots 118 in lamellar plates 105. The location of sleeve 106 in slots 118 determines the position of back rest carrier 102 with respect to carrier part 101. A lamellar disk A fits between each adjacent pair of lamellar plates 105 forming a lamellar stack 150. Lamellar disks A have a circular hole through which sleeve 106 and holding bolt 104 passes. Thus when back rest carrier 102 moves relative to carrier part 101, lamellar disks A move with holding bolt 104 and sleeve 106 sliding along the adjacent lamellar plates 105.

Figure 11:
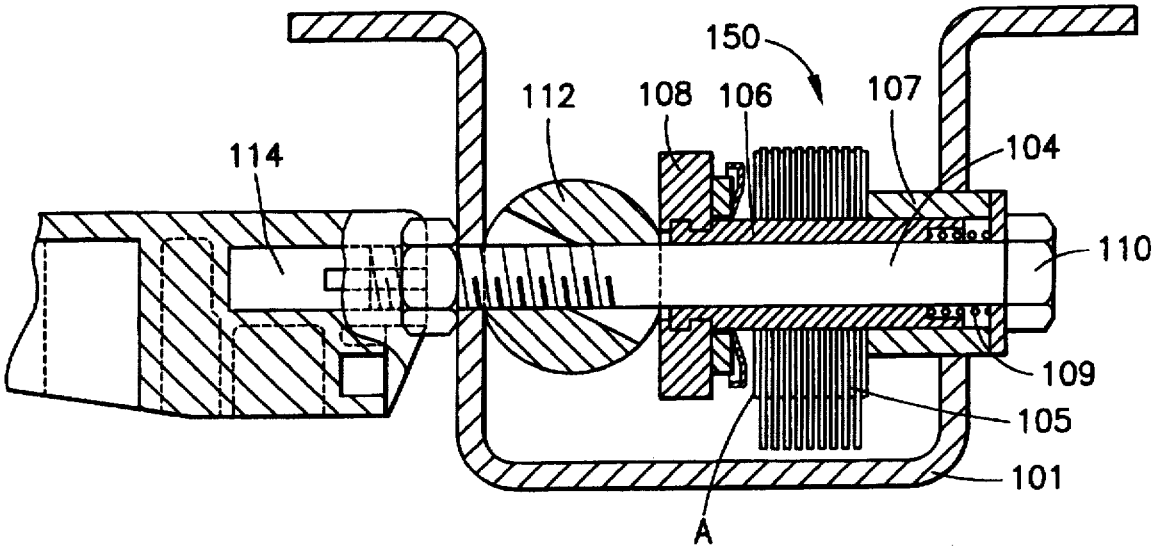
FIG. 11 is a cross-sectional view of the seat carrier shown in FIG. 10 with actuator lever in a first position.
Figure 12:
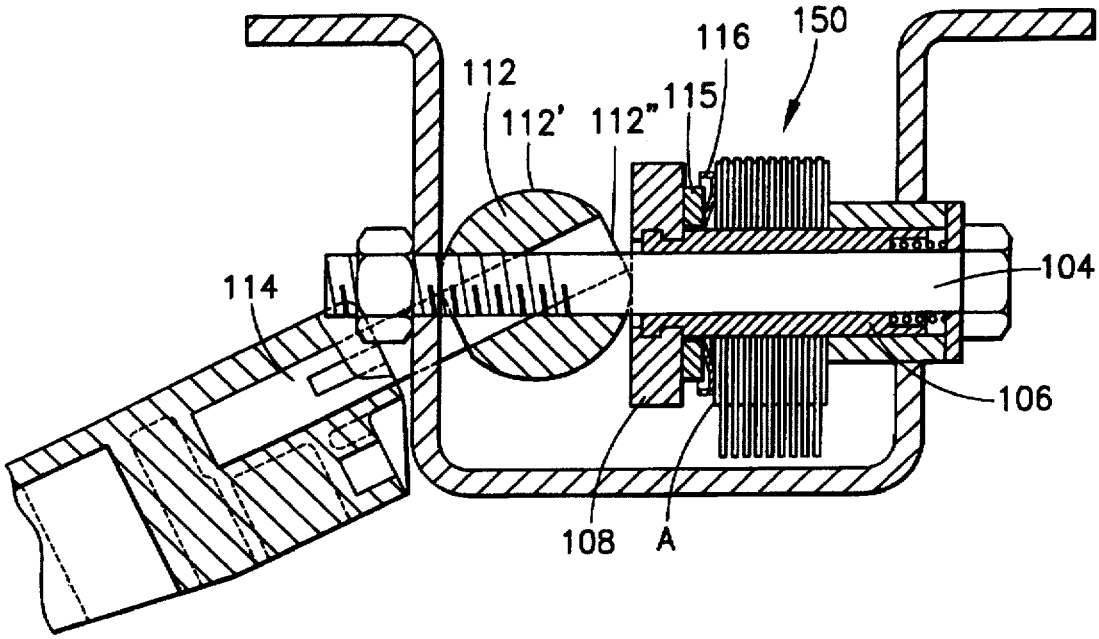
FIG. 12 is a cross-sectional view of the seat carrier shown in FIG. 10 with actuator lever in a second position.

Referring now to FIGS. 11–12, a sleeve 106 passes through slots 118 in lamellar stack 150. One end of sleeve 106 has a flange 108 which can be pressed by clamping means 112 against lamellar stack 150. A washer 115 and cup spring 116 are located between flange 108 and lamellar stack 150. On an end opposing flange 108, sleeve 106 is urged away from a bearing/stop collar 107 by a weak pressure spring 109. Bearing/stop collar 107 abuts a head 110 of holding bolt 104. At an end opposite head 110, holding bolt 104 is held in place, by a nut 111, to the side of carrier part 101 (shown in FIG. 10). Holding bolt 104 is slidably inserted in sleeve 106.

A clamping means 112 is an elongated cylindrical clamping body with two flattened sides 112" (FIG. 12). Clamping means 112 is rotatably mounted on holding member 104 and on cross bolt 113 parallel to the longitudinal axis of carrier part 101 (shown in FIG. 10). The mounting is accomplished by appropriately formed cross holes in clamping means 112. Between the two mountings, clamping means 112 is connected to an actuator lever 114. The actuator lever can be activated from the outside carrier part 101.

Flattened sides 112" of clamping means 112 are arranged such that one lies in a position parallel to flange 108, and the other parallel to the lateral wall of carrier part 101. In this position (shown in FIG. 11) no clamping force is exerted on the stack of lamellar plates 105. When clamping means 112 is rotated slightly (as shown in FIG. 12) larger cylindrical sides 112' of clamping means 112 press against the lateral wall of carrier part 101 and on flange 108, squeezing lamellar stack 150.

As described in the first and second embodiments, primary frictional force between lamellar plates 105 and lamellar disks A is maintained by secondary frictional force when the clamping force is broken. Primary frictional force between lamellar plates 105 and lamellar disks A is broken only through a mechanical force which releases the secondary frictional force after the clamping force is released, such as the movement of the back rest carrier 102.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

For example, the same frictional force between the lamellar plates and the lamellar disks can be achieved by squeezing the lamellar plates and disks directly instead of having the clamping mechanism press the flange of the holding member that presses against the lamellar stack. A third spring or other urging means can be used in this optional configuration to maintain the holding member in a position such that the secondary frictional force can still be created between the holding member and the stack.

In another example of a change from the embodiments disclosed, the weak spring which urges the holding member against the secondary frictional force can be omitted. The holding member is not subject to the secondary frictional force once a movement of the backrest carrier releases the secondary frictional force. Once the secondary frictional force is released, the lamellar stack separates and the primary frictional force releases with or without the weak spring because without the secondary force there is nothing that holds the lamellar stack together. The weak spring is an aid in the loosening of the holding member from the lamellar stack and therefore facilitates the release of the primary frictional force but does not actually cause it. In a related modification to the preferred embodiments, the lamellar plates could be of a non-planar shape such that when they are squeezed, they exert a separating force against each other which accomplishes the same result as the weak spring. The separating force, like the weak spring, does not overcome the secondary frictional force alone.

What is claimed is:

1. A seat carrier, comprising:

a first part with a first friction element;

a second part with a second friction element adjacent said first friction element;

said first and second parts being movably interconnected;

first means for urging said first part with respect to said second part;

a holding element movably connected to said first part with at least a portion thereof adjacent said first friction element;

a releasable actuator element pressing said first friction element against said second friction element, whereby a first force of friction is generated between said first friction element and said second friction element;

said first force of friction being sufficient to prevent said first means for urging from moving said first part with respect to said second part;

said holding element being forced against at least one of said first and second friction elements by said force of said first means for urging to generate a second force of friction between said holding element and said at least one of said first and second friction elements;

said holding element being in a holding position effective to prevent a movement of said first friction element away from said second friction element; and said second force of friction being effective to maintain said holding element in said holding position, whereby said first friction element continues to be pressed against said second friction element after said actuator element is released, whereby said first force of friction is maintained.

2. The seat carrier of claim 1, wherein each of said first and second friction elements includes an opening through which at least a portion of said holding element passes.

3. The seat carrier of claim 2, wherein said holding member includes a cylinder.

4. The seat carrier of claim 3, wherein:

said cylinder has a first diameter; and said cylinder has a flange with a second diameter greater than said first diameter.

5. The seat carrier of claim 4, wherein said actuator element presses said flange against said first friction element to press said first friction element against said second friction element.

6. The seat carrier of claim 1, wherein said actuator element presses said holding element against said first friction element to press said first friction element against said second friction element.

7. The seat carrier of claim 1, wherein said actuator includes a tapered surface which acts on said holding element by a sliding action of said actuator.

8. The seat carrier of claim 1, wherein said actuator includes a tapered surface which acts on said holding element by a rotating action of said actuator.

9. The seat carrier of claim 1, wherein said actuator includes a cam having a flat portion and a cylindrical portion.

10. The seat carrier of claim 1, further comprising:

a weak spring positioned to urge said holding member against said second force of friction; and said weak spring being weaker than said second force of friction such that said weak spring urges said holding member after a release of said second friction force.

11. The seat carrier of claim 10, further comprising:

means for releasing said second force of friction;

said means for releasing including a means for moving one of said first and second parts against said force of said first means for urging, whereby said holding element is no longer forced against said at least one of said first and second friction elements by said force of said first means for urging and said second force of friction is released.

12. The seat carrier of claim 11, wherein each of said first and second friction elements includes an opening through which at least a portion of said holding element passes.

13. The seat carrier of claim 12, wherein said holding member includes a cylinder.

14. The seat carrier of claim 13, wherein:

said cylinder has a first diameter;

said cylinder has a flange with a second diameter greater than said first diameter; and said flange is held against a side of said first friction element by said second force of friction.

15. The seat carrier of claim 14 wherein said weak spring urges said flange away from said one of said first and second friction elements.

16. The seat carrier of claim 12, wherein:

said holding member has a first diameter;

said holding member has a flange with a second diameter greater than said first diameter; and said flange is held against a side of said first friction element by said second force of friction.

17. The seat carrier of claim 16, wherein said weak spring urges said flange away from said one of said first and second friction elements.

18. The seat carrier of claim 1, wherein said first friction element is one of a first series of first planar elements and said second friction element is one of a second series of second parallel planar elements.

19. The seat carrier of claim 18, wherein at least one of said first series is between two of said second series.

20. The seat carrier of claim 19, wherein each of one of said first and second series is pivotably connected to said first part.

21. The seat carrier of claim 1, wherein said first part is connected to one of a seat back and a seat platform and said second part is connected to the other of said seat back and a seat platform.

22. The seat carrier of claim 1, wherein each of one of said first and second series is pivotably connected to said first part.

23. A seat carrier, comprising:

a seat base;

a seat back movably connected to said seat base;

first means for urging said seat back in a first direction with respect to said seat base;

a first friction element connected to said seat back;

a second friction element connected to said seat base;

said first and second friction elements having first and second adjacent surfaces, respectively;

at least one of said first and second friction elements having a third surface;

a holding element connected to one of said seat back and said seat base;

said holding element having a fourth surface adjacent said third surface;

second means for urging said holding element in a second direction against said first friction elements toward said second friction element, whereby said first and second surfaces are urged against each other to generate a first force of friction;

said second means for urging being such that said first force of friction is sufficient to prevent said first means for urging from moving said seat back in said first direction with respect to said seat base; and said first means for urging including means for pressing said third surface against said fourth surface generating a second force of friction that prevents said holding element from moving when said second means for urging is removed, such that said first force of friction is maintained.

24. The seat carrier of claim 23, wherein each of said first and second friction elements includes an opening through which at least a portion of said holding element passes.

25. The seat carrier of claim 24, wherein said holding element includes a cylindrical portion.

26. The seat carrier of claim 25, wherein:

said cylindrical portion has a first diameter;

said holding element has a flange portion coaxial with said cylindrical portion;

said flange portion has an outer diameter greater than said cylindrical portion; and said flange is held against at least one of said first and second friction elements by said second force of friction.

27. The seat carrier of claim 26, wherein said second means for urging acts on said flange of said holding member.

28. A seat carrier as in claim 23, further comprising:

third means for urging said holding means in a third direction opposite said second direction;

said third means for urging being such that said holding element is not moved in said third direction under an urging of said third means for urging until said second force of friction is released.

29. The seat carrier of claim 28, further including means for releasing said second force of friction including a means for urging one of said seat base and seat back against said first means for urging.

30. The seat carrier of claim 28, wherein each of said first and second friction elements includes an opening through which at least a portion of said holding element passes.

31. The seat carrier of claim 30, wherein:

said holding element has a flange;

said flange is held against at least one of said first and second friction elements by said second force of friction; and said third means for urging presses said flange away from said one of said first and second friction elements.

32. The seat carrier of claim 31, wherein:

said holding element includes a cylinder portion with a first diameter; and said flange has a second diameter greater than said first.

33. The seat carrier of claim 23, wherein said second means for urging includes a tapered surface which acts on salad holding element by a sliding of said tapered surface relative to said holding element.

34. The seat carrier of claim 23, wherein said second means for urging includes a tapered surface which acts on said holding element by a rotating of said tapered surface relative to said holding element.

35. The seat carrier of claim 23, wherein said second means for urging includes a cam with at least one flat side which acts on said holding element by a rotation thereof.

36. The seat carrier of claim 23, wherein one of said first and second friction elements is connected to said holding element such that said holding element moves with said one of said first and second friction elements relative to another of said first and second friction elements.

37. The seat carrier of claim 23, wherein each of said first and second friction elements is one of a series of parallel planar elements.

38. The seat carrier of claim 37, wherein one of said first and second friction elements is connected to said holding element such that said holding member moves with said one of said first and second friction elements relative to another of said first and second friction elements.

39. A seat carrier, comprising:

a seat base;

a seat back movably connected to said seat base;

first means for urging said seat back in a first direction with respect to said seat base;

a locking mechanism;

said locking mechanism movably connected to said seat base and said seat back;

a holding member connecting said locking mechanism to said seat base;

said locking member including at least first and second friction elements;

means for applying and releasing a clamping force on said locking member;

said clamping force creating a first frictional force between said at least first and second friction elements;

said first frictional force being effective to hold a position of said seat base and said seat back with respect to each other;

said first means for urging including means for pressing said holding member against said at least first and second friction elements generating a second frictional force; and said second frictional force being effective to maintain said first frictional force after said clamping force is released.

40. The seat carrier of claim 39, further including:

second means for urging said holding member against said second frictional force;

said second means for urging being such that said holding member is not moved by said second means for urging until said second frictional force is released.

41. The seat carrier of claim 40, further including means for releasing said second force of friction including a means for moving one of said seat base and said seat back against said first means for urging.

42. The seat carrier of claim 40, wherein said at least first and second friction elements each include an opening through which at least a portion of said holding member passes.

43. The seat carrier of claim 42, wherein:

said holding member has a flange;

said flange is held against at least one of said at least first and second friction elements by said second frictional force; and said second means for urging presses said flange away from said one of said at least first and second friction elements.

44. The seat carrier of claim 43, wherein:

said holding member includes a cylinder portion with a first diameter; and said flange has a second diameter greater than the first.

45. The seat carrier of claim 43, wherein said clamping force presses said flange of said holding member against said at least first and second friction elements.

46. The seat carrier of claim 39, wherein said first and second friction elements each include an opening through which at least a portion of said holding member passes.

47. The seat carrier of claim 46, wherein:

said holding member has a flange; and said flange is held against at least one of said at least first and second friction elements by said second frictional force.

48. The seat carrier of claim 47, wherein:

said holding member includes a cylinder portion with a first diameter; and said flange has a second diameter greater than said first diameter.

49. The seat carrier of claim 47, wherein said clamping force presses said flange of said holding member against said at least first and second friction elements.

50. The seat carrier of claim 39, wherein said means for applying a clamping force includes means for sliding two tapered surfaces against each other to effect said clamping force.

51. The seat carrier of claim 39, wherein said means for applying a clamping force includes means for rotating two tapered surfaces against each other to effect said clamping force.

52. The seat carrier of claim 39, wherein:

said means for applying a clamping force includes a cam with a flat surface and a cylindrical surface.

53. A seat carrier comprising:

a first seat element with a first friction element;

a second seat element with a second friction element;

a third friction element and a fourth friction element being positioned on either side of said first and second friction elements;

a spring compressed between said first seat element and said second seat element such that said spring urges said first seat element in a first direction relative to said second seat element;

a holding element engageable with said third and fourth friction elements; and a clamp positioned to press said first, second, third, and fourth friction elements together to generate a first force of friction between said first and second friction elements opposing said first direction when said clamp is engaged;

said third friction element and said fourth friction element being urged to clamp said holding element therebetween and to generate a second force of friction between said holding element and said third and fourth friction elements along a second direction, said second force of friction being aligned to prevent said third friction element from separating from said fourth friction element after said clamp is released, whereby said first and second friction elements remain pressed against each other and said first force of friction is maintained after said clamp is released.

* * * * *